United States Patent [19]

Fair

[11] Patent Number: 4,996,720

[45] Date of Patent: Mar. 5, 1991

[54] PROTECTIVE VEST HAVING A CERVICAL COLLAR

[76] Inventor: Jeffrey D. Fair, 4801 N. Britton, Stillwater, Okla. 74075

[21] Appl. No.: 305,153

[22] Filed: Feb. 1, 1989

Related U.S. Application Data

[63] Continuation-in-part of Ser. No. 65,859, Jun. 23, 1987.

[51] Int. Cl.[5] ..... A41D 13/00

[52] U.S. Cl. ..... 2/2; 2/44; 2/92

[58] Field of Search ..... 2/2, 44, 92, 102

[56] References Cited

U.S. PATENT DOCUMENTS

| | | | |
|---|---|---|---|
| 1,489,048 | 4/1924 | Whitley | 2/2 |
| 1,687,126 | 10/1928 | Goldsmith | 2/2 |
| 1,764,667 | 6/1930 | Whitley | 2/2 |
| 3,189,917 | 6/1965 | Sims | 2/2 X |
| 3,497,872 | 3/1970 | Mitchell | 2/2 |
| 3,514,784 | 6/1970 | McDavid | 2/2 |
| 3,855,631 | 12/1974 | Ettinger | 2/2 |
| 4,338,685 | 7/1982 | LaPorta, Jr. | 2/2 |
| 4,425,667 | 1/1984 | Harrison | 2/2 |
| 4,501,023 | 2/1985 | Bilberry | 2/2 |
| 4,516,273 | 5/1985 | Gregory et al. | 2/2 |
| 4,547,905 | 10/1985 | La Porta, Jr. | 2/2 |
| 4,590,621 | 5/1986 | Flosi et al. | 2/2 |
| 4,590,622 | 5/1986 | Wolfe et al. | 2/2 |

*Primary Examiner*—Werner H. Schroeder
*Assistant Examiner*—Jeanette E. Chapman
*Attorney, Agent, or Firm*—Fitch, Even, Tabin & Flannery

[57] ABSTRACT

Disclosed is a protective vest having a collar or neck guard intended for use with helmets and, optionally, with shoulder pads or harnesses, of the types worn by players in contact sports. The protective vest has a flexible body with shoulder portions between chest and back panels. Surrounding an opening for receiving a player's neck is an upstanding collar, integrally formed with the body, which has an upper ring-like surface for contacting the bottom edge of the player's helmet. When contacted by the player's helmet, the collar, formed of resilient material, is placed in energy-absorbing compression. Also, the chest and back panels surrounding the collar, also being made of resilient material, are placed in a tension and compression loading, to further aid in absorbing the loading applied to the collar. The body member and, particularly, the chest and neck panels are pliable so as to conform to the topography of the player's upper torso and to frictionally engage the player's body and any clothing in contact with the player's body underneath the protective vest, so as to provide the frictional engagement necessary for efficient energy absorption.

15 Claims, 7 Drawing Sheets

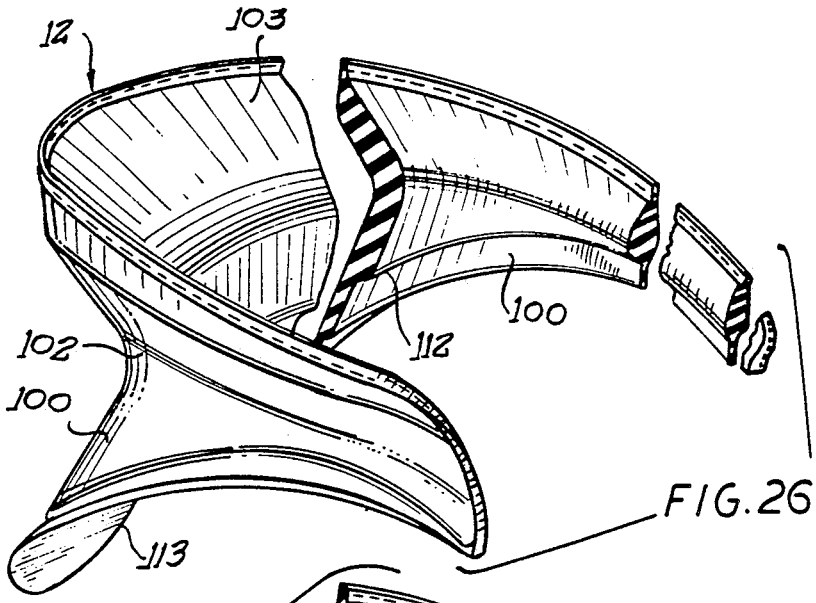
FIG. 26
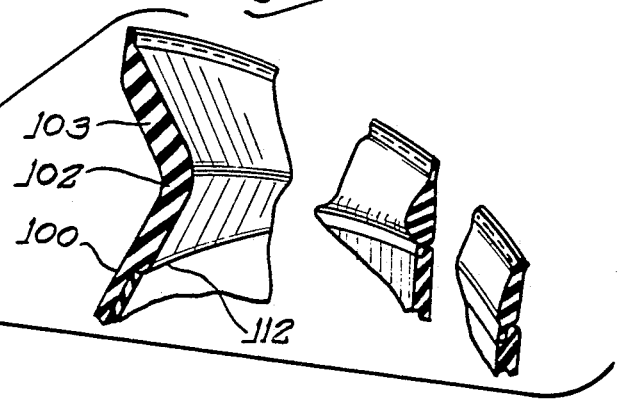
FIG. 27
FIG. 28
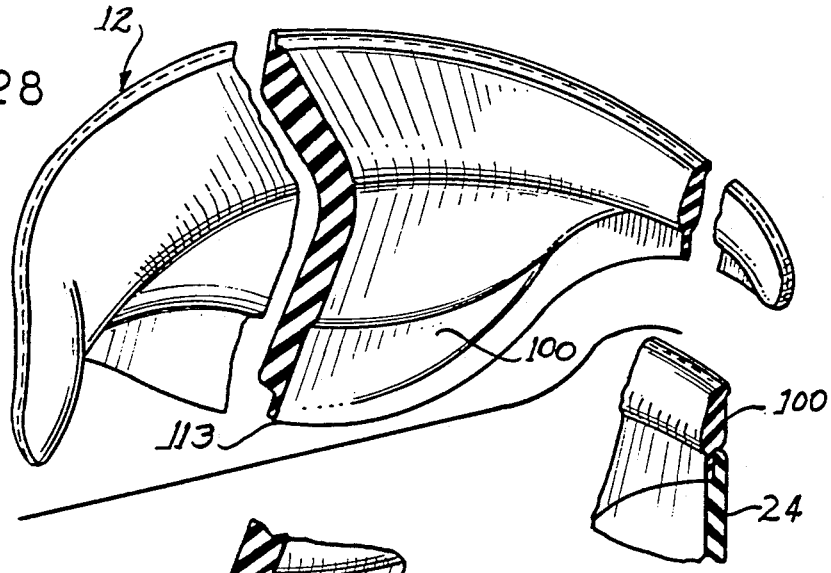
FIG. 29
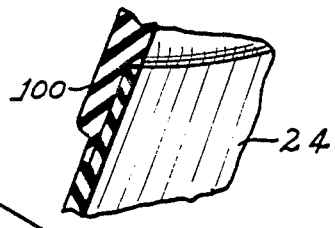

PROTECTIVE VEST HAVING A CERVICAL COLLAR

RELATED APPLICATIONS

This is a continuation-in-part of commonly assigned U.S. patent application Ser. No. 065,859 filed June 23, 1987.

BACKGROUND OF THE INVENTION

1. Field of the Invention

The present invention pertains to protective athletic equipment, particularly equipment for reducing or eliminating neck injuries.

2. Description of the Prior Art

Over the years, there have been significant improvements in protective equipment of the type worn by athletes, particularly athletes engaged in contact sports. Helmets, for example, have undergone considerable improvements in preventing the risk of concussion or bruising of the various portions of the top, sides and back of an athlete's head. Face guards and face shields have been added to reduce or prevent the risk of injury to a wearer's nose and face. U.S. Pat. No. 4,094,015, for example, shows yet another type of protective feature, that of a neck roll attached to the bottom of the helmet. The neck roll, made of cushion material, provides a cushioning effect when contacting the shoulders of a wearer, preventing damage when the wearer's head is rotated, hyperextended, or hyperflexed. However, since the neck roll is attached to the helmet, it does not cooperate with shoulder pads or the like shoulder protecting arrangements' to protect the wearer from risk of injury caused by a sideways displacement of the shoulder pads which presses the shoulder pads together, reducing the size of the neck opening. Also, during a whiplash-like excursion of the neck, for example, the neck roll can slide against the shoulder pads, thereby reducing the amount of energy it can absorb. Also, the neck roll fails to provide protection for other parts of the wearer's body, such as the shoulders, chest or upper back.

Cervical collars and the like devices have been developed exclusively to prevent the risk of injury to a player's neck, particularly when the player's head is twisted, rotated, and/or pushed upwardly toward the center of a player's torso. Hyperextension, rotational hyperextension, and whiplash are some of the more common types of injuries sustained by a player's neck when the head is deflected an unusual amount. U.S. Pat. No. 4,219,193 discloses a spring frame anchored to a player's shoulders which extends upward behind the rear of a player's helmet to alleviate these types of injuries. The spring framework, however, also resists a "normal" range of motion of a player's head, that which is usually not associated with injury caused by an unusual excursion of the neck. The spring framework is therefore not well-suited to competitive sports, in that it necessarily restricts the freedom of movement, and also since it has protrusions and surface irregularities which may be grasped or may become caught or snagged during the playing of a contact sport such as football.

U.S. Pat. No. 3,189,917 provides a neck collar designed to encircle the neck of a player, so as to be positioned between the bottom of the player's helmet and the player's shoulder pad. Since the protective collar is relatively small and lightweight, and is not secured to a larger, more massive piece of equipment such as the shoulder pads, it can easily become dislodged or dislocated. Further, as with the other devices mentioned above, the neck collar of the '917 patent is relatively inefficient in dissipating potentially injurious forces, and does not, for example, transmit those forces to a player's chest and upper back portions.

U.S. Pat. No. 3,514,784 discloses protective football apparatus mounted to or incorporated in the shoulder pads, having a rigid collar portion or guard to protect the player's neck. The guard is described as being made from a plastic or lightweight metal to prevent whiplash injury upon extreme rearward deflection of a player's head. While generally adequate in preventing contact and bruising type injuries associated with contact to the wearer's neck, the rigid neck guard does not offer a resilient absorption of neck-distorting forces experienced by deflection of a player's head. Further, the neck guard must be secured to the shoulder harness or shoulder pads at several points, and, in general, must be formed or at least adjusted for particular anatomical and shoulder pad configurations to provide the close fit needed for adequate protection. Further, although formed of lightweight material, the neck guard, which extends to cover the player's chest, is relatively massive and may tend to restrict some ranges of motion as the player moves during an athletic event.

U.S. Pat. No. 4,338,685 provides a cervical collar with chest and back plates which are secured to the player's shoulder harness at several points. The majority of the collar is generally rigid and inflexible, so as to transmit unusual distortions of a player's head and neck as cantilever forces are applied to the player's chest and upper back. The rigid collar construction increases the weight of the player's equipment, while restricting the player's mobility. This is also true of the plates which encase or enclose major portions of the player's chest and back, to which the rigid collar members are riveted or otherwise securely fastened. A cushioning ring-like pad attached to the chest and back plates surrounds an opening which receives the player's neck. Proper alignment of the cushioning ring-like pad or collar surrounding the neck opening may be lost when the player's shoulder harness or shoulder pads are deflected either by an edge-wise, or upwardly-directed force, tending to dislodge or otherwise dislocate the shoulder harness. Further, to provide a close fit needed to reduce the effect of dislodging forces, the cervical collar construction must be configured for a particular player's anatomy and shoulder pad configuration.

Many of the devices described above have the potential for contacting the bottom edge portion of a wearer's helmet. Under some conditions, an upward force can be applied to the wearer's helmet, thus placing the wearer's neck in tension. In general, it is desirable to avoid placing an athlete's neck in tension, should the athlete undergo an injury, given certain sequence of body movements which might tend to cause discomfort to a certain group of individuals. Accordingly, certain advantages in player protection can be realized if, in addition to cushioning or otherwise retarding an unusual range of motion of a wearer's neck, any pushing against the bottom of the wearer's helmet is avoided.

SUMMARY OF THE INVENTION

It is an object of the present invention to provide a protective cervical device which conforms closely to a particular player's anatomy, while being formed separately and independently of a helmet, shoulder pads, or other equipment that may be worn by the player.

Another object of the present invention is to provide a device for protecting a player's neck without adding significantly to the weight that a player must carry, and without significantly restricting the ranges of motion of various parts of the player's upper torso, including the player's shoulders and arms, as well as the player's head and neck.

Yet another object of the present invention is to provide a protective device which safely absorbs and dissipates forces applied to a player's head, while eliminating the possibility that the head or neck of a player wearing a helmet, in addition to the neck device, will be subjected to forces which are generated by pushing against the bottom edge of the helmet.

Still another object of the present invention is to provide a device for protecting a player's neck in which any distortion or dislodging forces to the protective device are resiliently resisted with bias forces which increase with the force applied and which quickly restore the device to its proper position, should minor distortions be experienced.

These and other objects of the present invention, which will become apparent from studying the appended claims and description are provided in a protective device for use with helmets of the type worn by players in contact sports, comprising:

a flexible body member of resilient material having shoulder and back members at least partially covering the shoulders and back of a player respectively;

a resilient upstanding collar having a lower hinge portion, an upper head contacting portion with an upstanding generally convex inner wall surface defining an upwardly opening passageway for receiving the neck and at least the lower portion of the head of a wearer of the device and an opposed generally concave outer wall surface;

said collar head contacting portion joined to said body member with a substantially continuous resilient hinge portion which deflects to absorb energy when said inner wall surface of said collar is depressed by the head or helmet of a player wearing the device; and said body member having an inner surface for frictionally engaging the body of a wearer so as to maintain said upstanding collar in a preselected position about the body of a wearer, despite the application of forces thereto.

In another of its aspects, applicant's claimed invention is directed to a protective device for use with helmets of the type worn by players in contact sports, comprising:

a flexible body member of resilient material having shoulder and back portions, at least partially covering the shoulders and back of a player respectively;

an upstanding collar of resilient material having an inner wall surface defining an upwardly opening passageway for receiving the neck, and at least the lower portion of the head of a wearer of the device, and an opposed generally concave outer wall surface having a first concave configuration when unstressed;

joining means for substantially continuously joining said upstanding collar to said body member, so as to transmit forces to the body member which are applied to said upstanding collar by the head or helmet of a player wearing the device;

said upstanding collar being resiliently deformable so as to at least partially collapse said outer wall surface, increasing the concavity thereof when pressure is exerted against the inner surface of the collar by the head or helmet of a player wearing the device; and said body member having an inner surface for frictionally engaging the body of a wearer, so as to maintain said upstanding collar in a preselected position about the body of a wearer, despite deformation of said upstanding collar portion.

In other aspects, the present invention achieves objects and advantages in a protective device of the above types in which the collar has an upper head-contacting portion and a resilient hinge portion between the upper portion and the body member, and the concave outer surface of the collar spans both portions of the collar. Preferably, the inside surface of the collar is concave, or funnel-shaped, or conical, or upwardly opening and spans at least the head-contacting portion of the collar.

BRIEF DESCRIPTION OF THE DRAWINGS

In the drawings, wherein like elements are referenced alike;

FIGS. 14–20 show an alternative embodiment of a protective device constructed according to principles of the present invention, wherein FIG. 14 is a perspective view of a protective device with neck guard, illustrating aspects of the present invention;

FIG. 15 is a front elevational view of the protective device of FIG. 14;

FIG. 16 is a fragmentary, cross-sectional view taken along the lines 16—16 of FIG. 15;

FIG. 17 is a fragmentary, cross-sectional view taken along the line 17—17 of FIG. 16;

FIG. 18 is a rear elevational view of the protective device of the preceding figures;

FIG. 19 is a side elevational view of the protective device of the preceding figures; and FIG. 20 is a fragmentary view taken on an enlarged scale, showing the tip of the collar.

FIG. 26 is a fragmentary perspective view of the collar portion of FIGS. 1–13;

FIG. 27 is a fragmentary perspective view showing portions of the collar of FIG. 26 joined to the body member;

FIG. 28 is a fragmentary perspective view of the collar of FIG. 26, taken from a different viewing point;

FIG. 29 is a fragmentary perspective view showing portions of the collar of FIG. 28 joined to the body member;

DETAILED DESCRIPTION OF THE PREFERRED EMBODIMENTS

Figure 1:
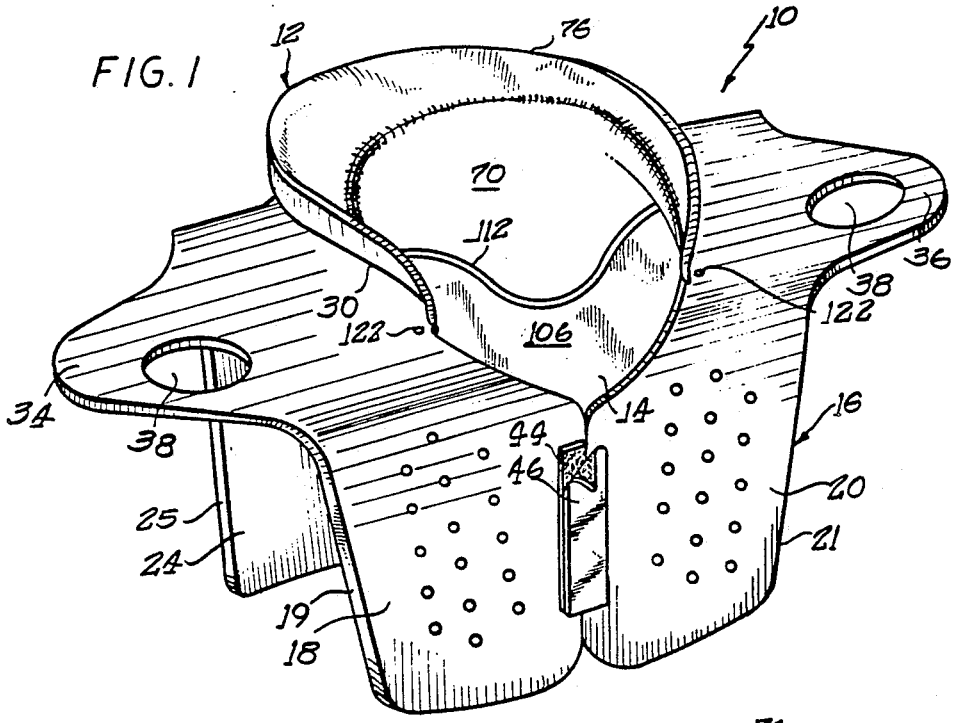
FIG. 1 is a perspective view of a protective vest with neck guard, illustrating aspects of the present invention.

Referring now to the drawings, a first embodiment of a protective device indicated generally at 10 is adapted to be worn about the shoulders, chest and back of a player. According to one aspect of the present invention, the protective device 10 is vest-like in construction and is formed of a resilient, pliable material such as a closed-cell foam, and preferably a cross-linked, closed cell foam. The device 10 illustrated in FIG. 1, has these features and also includes a raised collar 12 surrounding an opening 14 for receiving the player's head and neck.

Figure 3:
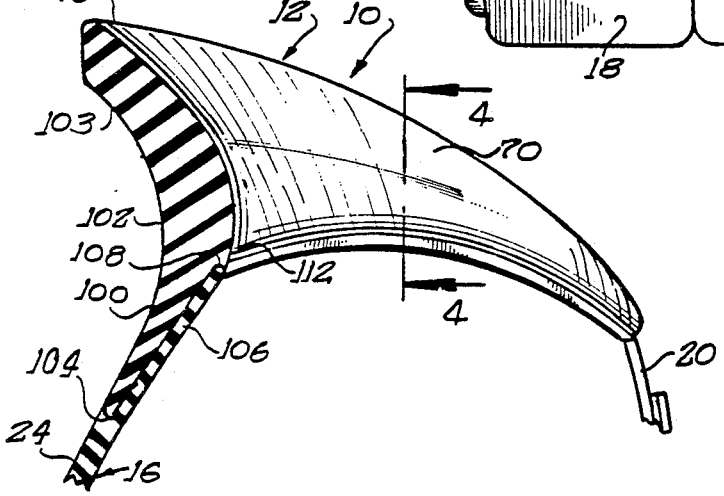
FIG. 3 is a fragmentary, cross-sectional view taken along the lines 3—3 of FIG. 2.

While the collar may be formed as part of a unitary construction, along with a flexible vest-like body, such as the body member 16 of device 10, and while a single mold could be developed for the protective device illustrated in FIG. 3 and the other figures, one particular advantage attainable with the protective device constructed according to principles of the present invention, is the economical construction made possible through a two-piece assembly of separate vest and collar portions. Collar 12 is preferably formed separately from the body member and subsequently joined thereto with a suitable adhesive.

Figure 30:
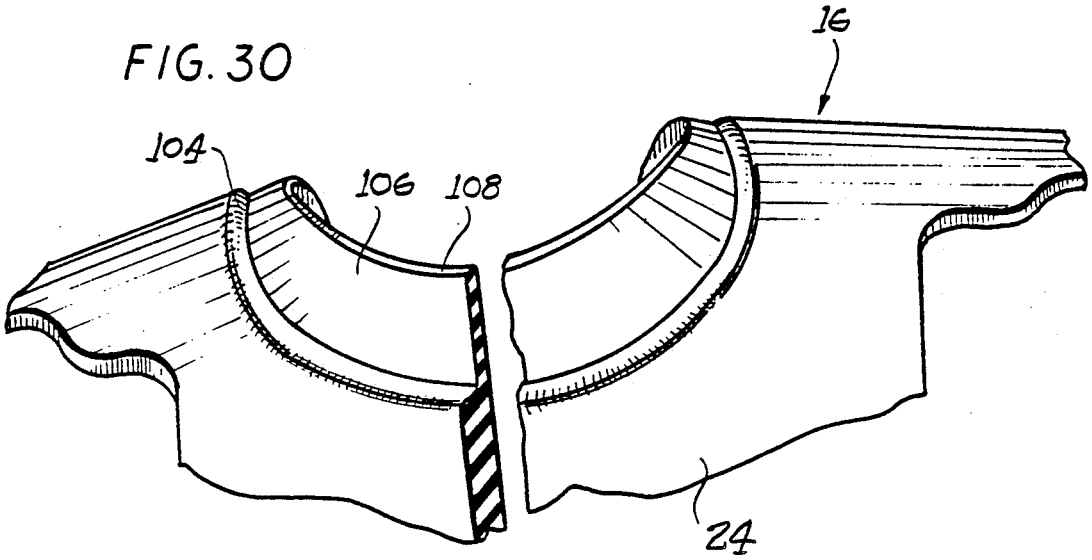
FIG. 30 is a fragmentary perspective view of the body member of FIGS. 1–13.
Figure 31:
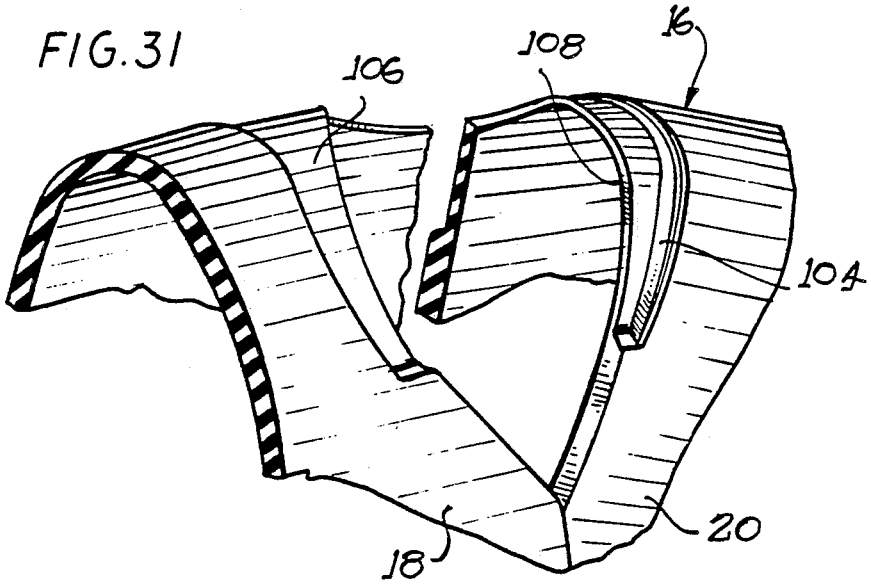
FIG. 31 is a fragmentary perspective view of the body member of FIG. 28, taken from a different viewing point.

The collar 12 is illustrated in greater detail in FIGS. 26–29, and the body portion is illustrated in FIGS. 30–31. The collar 12 has a lower, depressed panel 100 of reduced thickness and the body 16 has a depressed panel 106, also of reduced thickness. As will be seen herein, the depressed panels 100, 106 are bonded together to form a seam, as is illustrated, for example, in FIG. 3.

Figure 4:
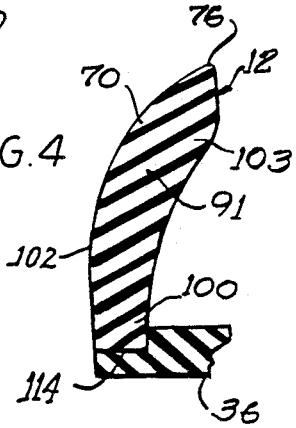
FIG. 4 is a fragmentary, cross-sectional view taken along the line 4—4 of FIG. 3.
Figure 5:
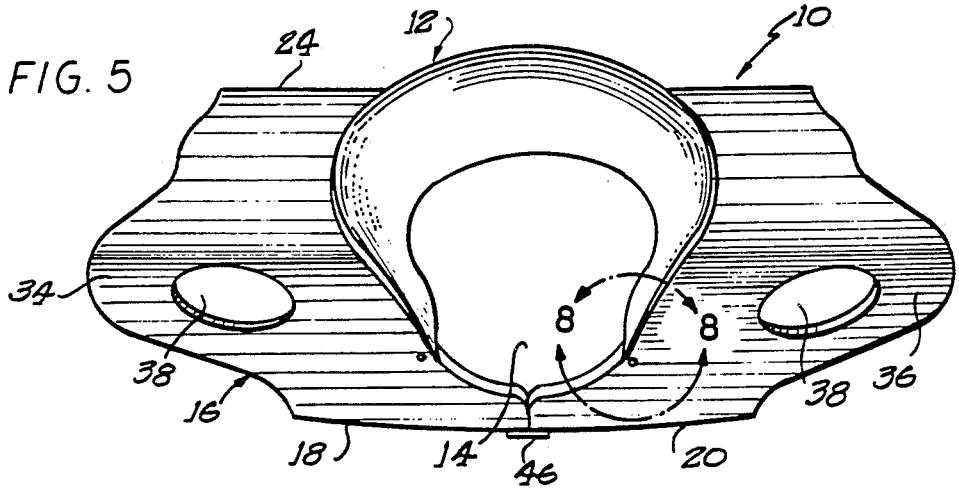
FIG. 5 is a top plan view of the protective vest of the preceding figures.

In the preferred embodiment of protective device 10, the vest-like body member 16 and the collar portion 12 are of substantially different thicknesses, as is most readily shown in FIG. 3 and FIG. 4. The relative thicknesses of the collar and body member were chosen, in part, because of the physical properties of the preferred foam material. For example, collar 12 has a greater thickness than body member 16 so as to provide an increased resistance to bending or the like deflection. Those skilled in the art, however, will appreciate that a different foam material may be chosen for the collar and accordingly, the thickness thereof could be reduced to a thickness approximating that of body member 16, if the replacement foam material offers a greater resilience resisting deformation.

As will be seen, the body member 16 may be made to have a generally constant thickness and accordingly, can be constructed as a curved sheet. The collar 12 departs from the curved sheet configuration and in addition, has a significantly greater thickness in portions thereof. For these reasons, it has been found convenient to form the collar and body member separately and to secure the two with a suitable adhesive. As will be seen, additional securement means will be provided at the free ends of collar 12 to provide additional reinforcement where the collar free ends are secured to the body member.

Body 16 includes a pair of opposed chest panels 18, 20 which are releasably separated from one another by hook and loop fastener material 44, 46 to allow easy fitting about the body of a wearer. Opposite the chest panels 18, 20 is a unitary back panel 24. Optional straps may also be employed to connect the lateral edges 25 of back panel 24 to the lateral edges 19,21 of respective chest panels 18, 20 by encircling the player's rib cage. Intermediate the back panel 24 and chest panels 18, 20 are shoulder portions 34, 36, which include apertures 38 to provide clearance for the protruding bone at the top of the player's shoulder.

Referring especially to FIG. 1, the chest panels 18, 20 are preferably provided with opposed, confronting edges which are drawn adjacent one another when the protective device 10 is fitted to a wearer. The chest panels are preferably held together by hook and loop fasteners 44, 46 which are secured to respective panels 18, 20. As will be seen herein, forces applied to collar 12 by the excursion of a player's neck and various forces applied to the upper portion of a player's anatomy are resolved, at least partly, in the chest panels 18, 20 of the device. The resolution of forces appears primarily as a tension force in the chest panels, and accordingly, it is important that the chest panels be secured together so that a force applied to one chest panel may be transmitted to the other chest panel so as to provide greater support. The use of hook and loop fasteners 44, 46 have been found to be particularly efficient, especially when the fasteners 44, 46 extend throughout major portions of the abutting edges of the chest panels. The strength of the hook and loop fasteners is also important to prevent separation of the chest panels which might lead to dislocation of the protective device from its intended positioning about the upper torso of a wearer.

Figure 2:
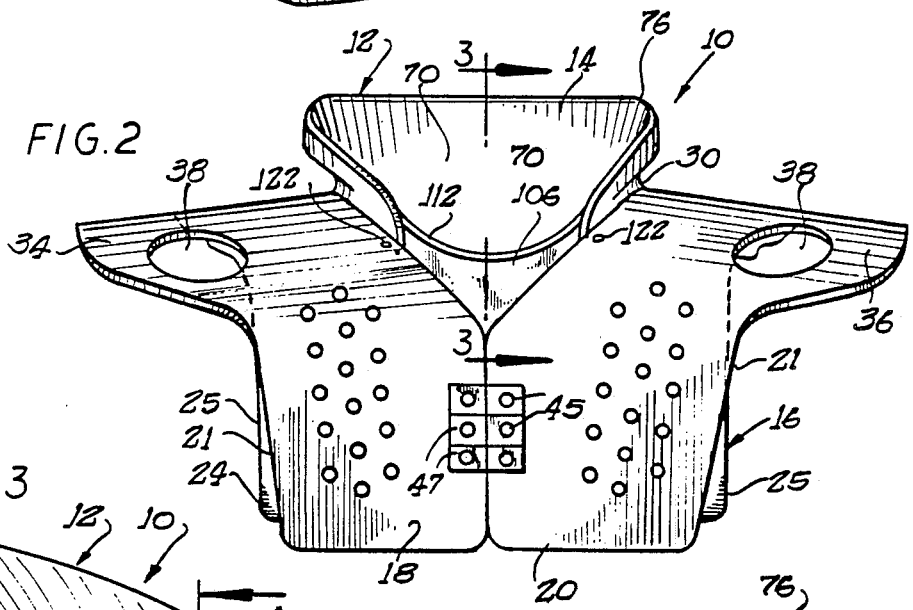
FIG. 2 is a front elevational view of the protective vest of FIG. 1.

Referring to FIG. 2, the chest panels could also be joined together by eyelets 45, which, along with reinforcing tabs 47, are attached directly to the individual chest panels 18,20. Other conventional means of removably joining the chest panels together may also be used to provide a protective device 10 which includes a chest panel comprised of two separable parts, so as to provide ready placement about the upper torso of a wearer.

According to one aspect of the present invention, the raised collar 12 extends into and above the neck opening of any shoulder harness or shoulder pads a player might be wearing. Also, as will be seen, the raised collar according to the present invention presents a concave surface to the edges of the shoulder pads, to help in maintaining the protective device in its proper position, and to cooperate with other portions of the collar and body member so as to provide, for example, a resilient hinge to dissipate energy.

In the preferred arrangement, a concave side surface 30 of the collar is in contact with or is located immediately adjacent to the inside edge of the shoulder pads, with the lateral thickness of the raised collar 12 being constantly positioned between the shoulder harness and the player's neck. This prevents risk of injury, particularly a bruising or pinching injury to the neck caused when the player's shoulder pads are compressed together, reducing the neck-receiving opening between the shoulder pads. With the raised collar 12 of the present invention, a substantial thickness of foam material is provided to reduce risk of this type of injury, and to provide other advantages, such as dissipation of forces to the wearer's head and neck.

One important aspect of the present invention is the ability of device 10 to resist dislocation when forceful contact therewith is made during the course of an athletic event. Device 10 is intended to be worn underneath the shoulder harness or shoulder pads in contact with the player's body which, for the purpose of explaining aspects of the present invention, means either that the device (and especially the body member 16 thereof) is in contact with relatively tight-fitting clothing or directly contacts the player's anatomy.

According to one aspect of the present invention, the body 16 of device 10 is made of a resilient material such as cross-linked, closed-cell foam, which is sufficiently supple or pliable so as to generally conform to the topographical features of a player's anatomy in static, flexed, and moving conditions as would occur during the course of an athletic contest. This allows an intimate conformity and engagement with the player's upper torso (or clothing worn about the upper torso) over a majority of the upper torso surface area. Preferably, the pliable, resilient material of body 16 has a significant coefficient of friction which, in conjunction with the large area of engagement, covering the chest and back of a player, provides very substantial frictional forces which resist applied forces tending to dislodge or dislocate device 10.

Due to the resilient nature of the material from which body 16 is formed, the greatly enhanced frictional engagement, or anchoring, of the body of the device to a player transforms the dislodging force into a deforming force, which not only enhances the frictional engagement, but also applies those forces to stretch local areas of significant size, so as to very effectively absorb and dissipate the applied forces. Due to the inherent resilience of the material from which body 16 is formed, energy absorption increases as the applied forces increase. The large area, supple panels of body member 16 very closely follow the complex and rapid movements of a player's body, maintaining the desired engagement necessary for effective energy absorption throughout the player's range of motion. Thus, it can be seen that the raised collar portion 12 is maintained in its desired position to an extent heretofore unrealized with prior art protective equipment.

As is made apparent from the above, an important aspect of the present invention is the ability of device 10 to be placed in tension, so as to absorb portions of the loading applied to the collar. It is important that the body 16 have relatively large areas engaging the body and/or clothing of a player and that it remain in frictional engagement during times of loading, for example, when the player is being blocked or tackled. Accordingly, it is contemplated that device 10 be worn under a relatively close-fitting outer garment, particularly if the straps between the back and chest panels are omitted. For example, if device 10 is worn under a relatively close-fitting jersey, the chest panels 18,20 and back panel 24 will remain in engagement with (i.e., pressed against) the player's upper torso, thereby providing the frictional engagement needed for effective load absorption. The releasable hook and loop fasteners 44,46 serve an important function in this regard.

If, however, the player is not wearing a close-fitting outer garment, or if even greater frictional engagement is desired, the girdling-type straps between edges of the back and chest panels can provide even greater engagement with the player's upper torso. The straps could comprise, for example, a stretch fabric or a soft, resilient netting. Non-elastic materials could also be used. Alternatively, the foam material of body member 16 can be extended on the lateral sides of the player's rib cage and secured to the chest panels with hook and loop fastener material, if greater protection of the player's rib cage is desired. In this connection, it will now be appreciated that body 16, when formed of a resilient material such as foam, also provides a padding protection of the player's upper torso, including, most importantly, the kidneys, rib cage, collarbone and shoulders of the player, areas in which greater protection is frequently desired and often needed.

If desired, the back panel, chest panel, or the shoulder portion of body 16, can be made from a thicker or more resilient foam material to provide any added padding required. Foam material is especially advantageous in this regard since a blow to some portion of the foam material usually results not only in a compression of that area, but in a tension and stretching of the surrounding area. If, however, additional padding is not required and optimal freedom of movement is desired, body 16 can be formed from a cross-linked, closed-cell foam of thickness ranging between approximately $\frac{1}{4}''$ and approximately $\frac{3}{8}''$ in thickness.

As will be apparent to athletes and to those constructing protective devices for athletes, it is important that the foam material of the device 10 not become waterlogged throughout the course of an athletic event. Accordingly, the closed-cell foam referred to above offers advantages in this regard, in addition to the desired resilience characteristics arising from its physical properties. If, however, device 10 is formed of a more absorbent material, the inner surface of body member 16, and of collar 12, and those surfaces in contact with a player's anatomy, can be coated or covered with a flexible moisture barrier to prevent the intrusion of moisture. Also, when playing in inclement weather, it is desirable to provide the outer surfaces of device 10 with a similar moisture barrier to prevent intrusion from rain, sleet, or the like. It is important that moisture not be trapped within the collar and body of device 10, because the player would be made to carry additional weight and also because the ability of the foam material to respond quickly to absorb and dissipate energy when placed under load, may be adversely affected. For example, a waterlogged foam material may exhibit a dampened response causing a slower reaction to imparted stresses, compared to performance of the protective device in a dry condition.

As mentioned above, in the preferred embodiment, collar 12 is separately formed from body member 16. Due to the complex manner in which protective device 10 dissipates forces tending to the distort a player's head and neck, it is important that collar 12 be joined to body member 16 in a manner which does not impede the free movement of the operative portions of protective device 10. Further, the preferred manner of attachment of the collar 12 to protective device 10 resists separation, despite forces that may be imparted thereto during the course of an athletic event.

Figure 6:
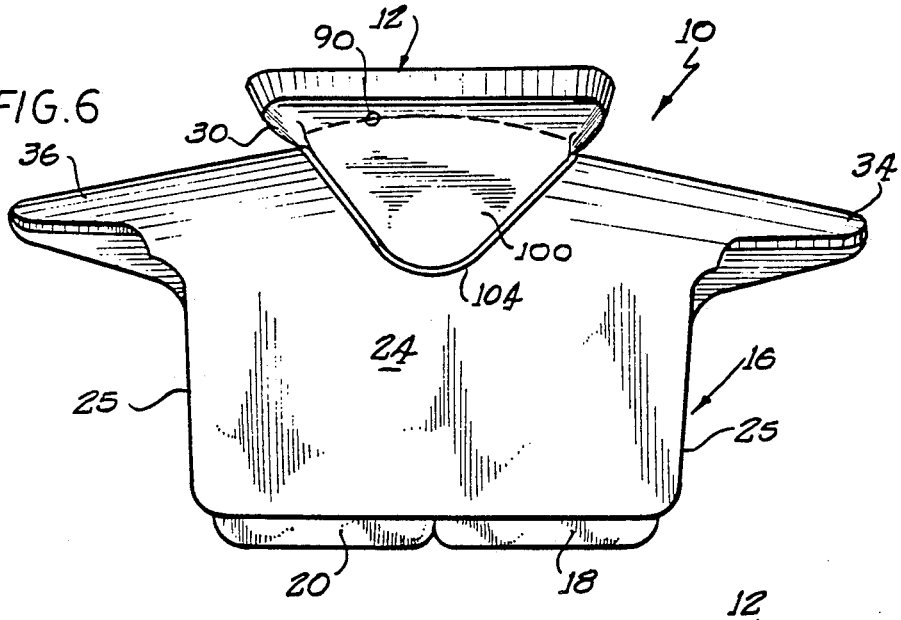
FIG. 6 is a rear elevational view of the protective vest of the preceding figures.

With reference to FIGS. 3 and 27–31, the preferred manner of joining collar 12 to the body member 16 will be described. The collar 12 includes a depressed lower border panel 100, an intermediate flexible portion 102 and an upper head-contacting portion 103. The lower border portion 100 overlies the central portion of body member 16, surrounding opening 14. As can be seen in the rear elevational view of FIG. 6, the border 100 of collar 12 is generally triangular-shaped, with a tip extending downwardly into back panel 24. The border panel 100 is depressed, i.e., has a reduced thickness compared to the other portions of the collar, and has an interior surface which closely conforms to the outer surface of body member 16.

As illustrated in FIGS. 3, 30 and 31, the upper portion of body member 16 has a lower lateral offset or depressed panel 100 forming a ridge 104 at its interior margin. The depressed panel 103 has an upper free edge 108. The depressed panel 100 forms an offset or ridge 112 at its interior edge and has an opposed free edge 113 (see FIGS. 26 and 27). The depressed panels 100, 106 are joined together and the ridges 104, 112 thereof cover the free edges of border panels 100, 106 to provide a protective device with a continuously smooth, blended surface at the inside and outside thereof. A suitable, resilient adhesive is used to bond the opposed surfaces of the depressed panels 100, 106.

With reference to FIGS. 3, and 27–31 the preferred manner of joining collar 12 to the body member 16 will be described. The collar 12 includes a depressed, lower border panel 100, an intermediate flexible portion 102 and an upper head-contacting portion 103. The lower border panel 100 overlies the central portion of body member 16, surrounding opening 14. As can be seen in the rear elevational view of FIG. 6, the border panel 100 of collar 12 is generally triangular-shaped, with a tip extending downwardly into back panel 24. The border panel 100 is depressed, i.e., has a reduced thickness compared to the other portions of the collar, and has an interior surface which closely conforms to the outer surface of body member 16.

As illustrated in FIGS. 3, 30 and 31 the upper portion of body member 16 has a lower lateral offset or depressed panel 100 forming a ridge 104 at its interior margin. The depressed panel 103 has an upper free edge 108. The depressed panel 100 forms an offset or ridge 112 at its interior edge and has an opposed free edge 113 (see FIGS. 26 and 27). The depressed panels 100, 106 are joined together and the ridges 104, 112 thereof cover the free edges of border panels 106, 100, 106 to provide a protective device with a continuously smooth, blended surface at the inside and outside thereof. A suitable, resilient adhesive is used to bond the opposed surfaces of the depressed panels 100, 106.

As can now be seen, the seam joining the collar and body members illustrated in FIG. 3, comprises the overlying joinder of two depressed border panels, and includes a pair of ridges which at least partially overlie outer free edges of the collar and body components of the protective device, so as to prevent the separation of the overlapping seam.

Figure 8:
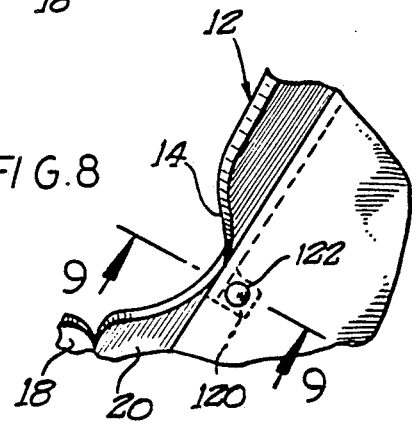
FIG. 8 is a fragmentary view taken on an enlarged scale, showing the circled portion of FIG. 5.
Figure 9:
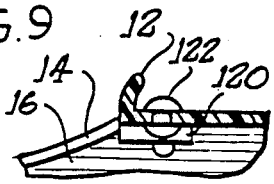
FIG. 9 is a fragmentary, cross-sectional view taken along the line 9—9 of FIG. 8.
Figure 10:
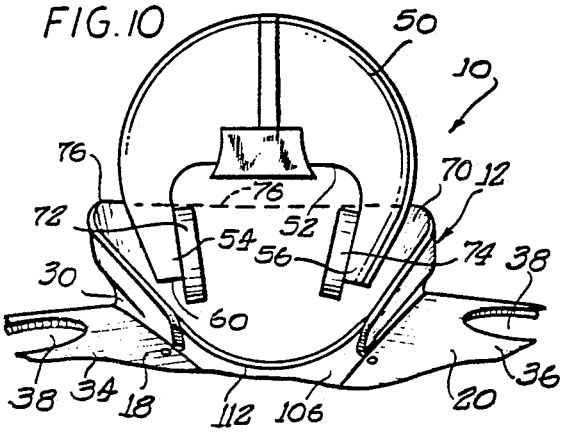
FIG. 10 is a fragmentary, front elevational view showing the protective vest of the preceding figures, in combination with a helmet indicating the spatial relationship between the two when worn by a player.

With reference to FIGS. 8 and 9, it has been found convenient to provide additional securement at the free end of collar 12 to prevent its separation from body member 16. The free end of collar 12 includes an outwardly extending tab portion 120 which engages the interior surface of body member 16, adjacent the opening 14 thereof. Although an adhesive joinder of tab 120 to body member 16 may be sufficient, it has been found desirable to include a fastener 122 such as a rivet to further strengthen the joint, preventing separation of the collar free end from the body member.

As illustrated in FIG. 9, the tab portion 120 extends underneath the body member 106. If desired, however, the tab portion 120 could lie on the upper surface of body member 16, so as to provide a smooth inner surface adjacent the player's anatomy.

Figure 12:
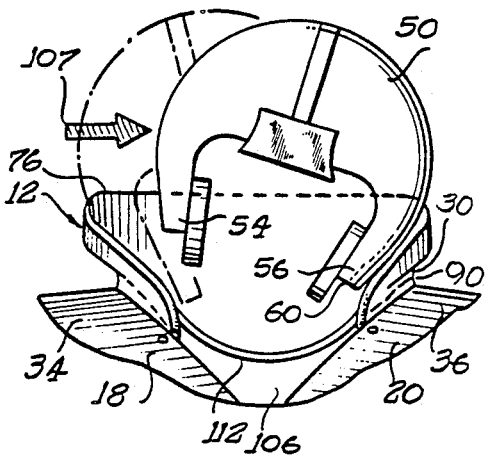
FIG. 12 is a fragmentary, front elevational view similar to that of FIG. 10, but showing the helmet being displaced through a range of motion as when a player's neck is stressed during an athletic event.
Figure 11:
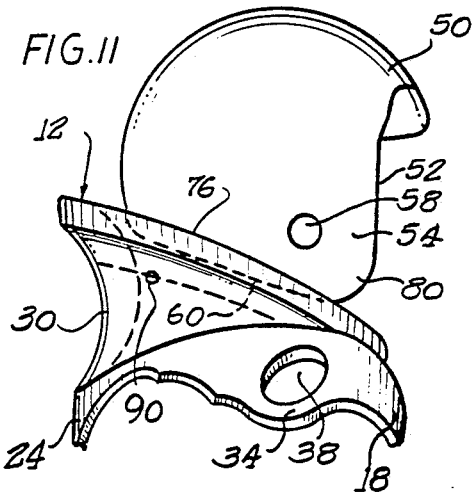
FIG. 11 is a side elevational view of a helmet and protective vest of FIG. 10.
Figure 13:
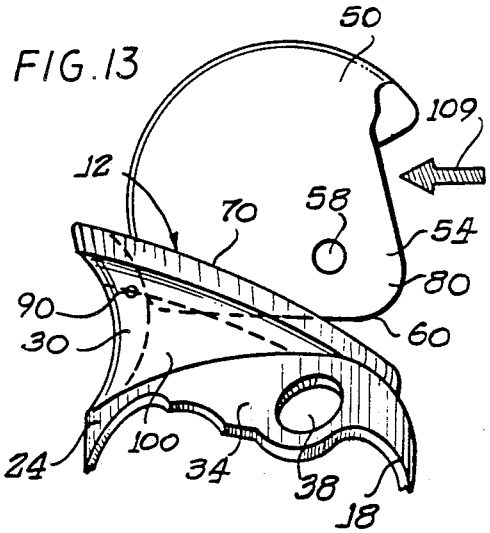
FIG. 13 shows a rearward displacement of a helmet, as worn by a player as might occur in a sporting event.

With reference to FIGS. 10–13, several advantages of protective device 10 will be described with reference to a player wearing a protective helmet 50 in conjunction with the protective device 10. Helmet 50, as illustrated, is of a conventional design having an opening 52 for the face of the wearer and side portions 54, 56 for protecting the ears and the sides of a wearer's face. Earholes 58 are illustrated in FIGS. 11 and 13. According to one aspect of the present invention, collar 12 has a configuration which ensures that the lower edges 60 of helmet 50 are not placed in compression by reason of movement of the helmet within the device 10, and particularly the collar portion thereof. Several features of collar 12 contributing to this improved performance are the convex or funnel-shaped contour of the inner surface 70 of collar 12, and the height of the side and back portions of collar 12 relative to the lower edge 60 of helmet 50. As can be seen in the front elevational views of FIGS. 10 and 12, the rear portion of collar 12 is about at the eye level of a wearer, and rises above the ear cushions 72, 74 which surround earholes 78 formed in the helmet sides 54, 56. In the preferred embodiment, the upper edge 76 of the rear portion of the collar 12 rises above the eyebrows, and extends behind the player's forehead when the player's head and neck are in upright, relaxed position. As can be seen in the side elevational views of FIGS. 11 and 13, the upper edge 76 of collar 12 rises above the bottom edge 60 of the wearer's helmet throughout all but only the forwardmost corner 80 of helmet 50.

It is generally preferred that the inner surface 70 of the head-contacting portion 103 of collar 12, that surface immediately opposite the sides and back of helmet 50 be continuously smooth, and have a rounded contour. The contour of the inside surface of collar 12 may be generally convex, but most preferably is generally conical to prevent binding of the lower edge 60 of the helmet with the collar in a manner which would apply an upward compressive force to helmet 50. The height of the upper edge 76 of collar 12 above the lower edge of helmet 50 further ensures that an upward compressive stress will not be imparted to the player's helmet. This has been found to be important because upper stresses to helmet 50 have the potential of placing the wearer's neck in tension. Certain theories being developed argue that the tensioning of a player's neck might predispose certain players to subsequent discomfort or possible injury when forces, particularly impulsive compression forces, are applied to the wearer's head when the neck is in a tensioning position In any event, it has been found desirable to ensure that a player's neck is not tensioned by the protective device, when worn in conjunction with a protective helmet. As illustrated in FIG. 12, a lateral dislocation to the player's head and neck is occasioned by a laterally directed force indicated by the arrow 107 in FIG. 12.

The lower surface 60, particularly at the side portion 56 of helmet 50, is cleared of compressive engagement with collar 12. The convex or conical interior configuration of interior surface 70 has been found to promote a camming or sliding against the side portions of the helmet when undergoing the lateral displacement in FIG. 12. In FIG. 13, the lower edge 60, at the rear portion of the player's helmet, is free of binding engagement with the interior surface of collar 12, permitting the rotation of the helmet 50 relative thereto.

Figure 7:
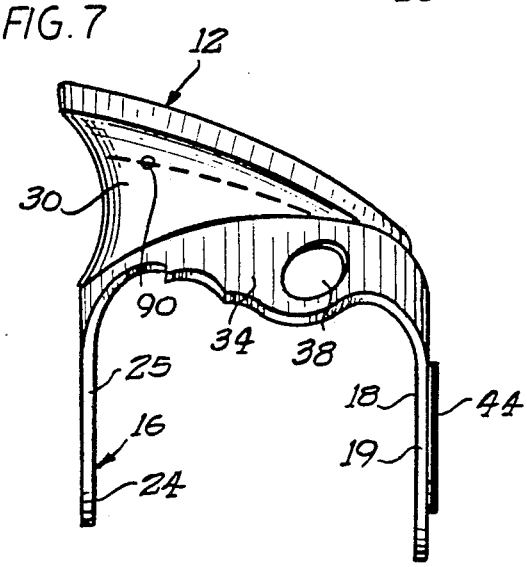
FIG. 7 is a side elevational view of the protective vest of the preceding figures.

One particular advantage of the collar and body member, constructed according to principles of the present invention, is the manner in which forces applied to a player's head and neck are dissipated in protective device 10. For example, referring to FIG. 12, a lateral dislocation of a player's helmet causes the upstanding collar to bend about a cease line or line of flexure 90, illustrated in phantom in the various FIGS. 3, 6 and 7, for example. With reference to FIG. 4, flexing of the front sections of the resilient upstanding collar 12 occurs adjacent its point of attachment to body member 16.

According to one aspect of the present invention, the desired flexing is provided by the generally opposed concave and convex surfaces 70, 30 respectively. These generally opposed surfaces provide a collar having a cross-section which ensures that the upper portion of the collar will bend in an outward direction, the bending being resisted by the resilience of the collar material which is placed in a bending stress, which is theoretically developed along a curved line intermediate the inner and outer collar surfaces 70, 30 respectively. In the preferred embodiment, flexure or bending of the collar is controlled so as to occur about line 91 located internally of the collar, and, visible as a point in the cross-sectional view of FIG. 4. With reference to the concave outer surface 30 of the collar, when flexed about the internal line 91, collar 12 is at least partially collapsed, so as to increase the concavity of surface 30. If desired, the inner and outer convex and concave surfaces 70, 30, can be altered so as to either raise or lower the internal line of flexure 91. Flexure about the internal line 91 can be observed as a flexure about line 90 on the external surface of the collar.

As will be seen, different configurations of collar 12 are possible in practicing the present invention. In each of the configurations, the collar has an outside, upstanding generally concave surface, and the opposed inside surface forms an opening for the head and neck of a wearer. The collar also has an upper head-contacting portion with a resilient hinge portion joining the head-contacting portion to the body of the protective device.

In addition to flexing of the upstanding collar along crease line 90 on the collar surface, forces applied to a wearer's head and neck, such as those illustrated in FIGS. 12, cause an outward bulging of the collar in a manner which elongates or otherwise stretchingly distorts the configuration of opening 14. For example, the lateral force of FIG. 12 causes portions of collar 12 adjacent to shoulder portion 36 to bulge in and outward direction, placing the rear portion of collar 12 in tension so that that portion of the collar is stretched in response to the distorting force.

Similarly, when a rearward directed force is applied to the player's head in the manner illustrated in FIG. 13, the rear portion of collar 12 bulges in an outward direction, with the side portions of the collar being stretched, and placed in tension. The continuous joinder of collar 12 to the body member 16 of the device 10 has been found to be particularly effective in restraining excursions of a player's head and neck. In addition, the continuous line of flexure encircling collar 12 has also been effective in providing a rapid response which is helpful in the rapid and effective dissipation of forces applied to a player's head and neck.

Protective device 10 described above, has a body with substantial chest portions 18, 20 and a back portion 24, covering significant amounts of a player's upper torso. The numerous advantages attained by the preferred embodiment of the present invention are also realized in an alternative, somewhat abbreviated embodiment illustrated in FIGS. 14–20. The alternative embodiment, which has relatively smaller body member, is generally indicated at 210. The protective device 210 includes a collar 212, substantially identical to the collar 12 described above, and a body member 216. The collar 212 is substantially identical in both construction and performance, compared to the collar 12 of protective device 10.

In the embodiment 210, the body member 216 includes shoulder portions 234, 236 which overlie a wearer's shoulders. The forward ends 218, 220 cover relatively minor portions of a player's front torso, and will be referred to herein as chest portions If desired, the chest portions 218, 220 can be lengthen or lowered to extend to a player's sternum, for example. The free ends of collar 212 are preferably secured to the forward portions of body 216 by hollow rivet fasteners 322. Tabs 320 outwardly extend from the forward tips of collar 212 and engage the underside surface of body 216. A pair of laces 244 are threaded through hollow fasteners 322 to provide closure for the protective device, adjacent the throat of a wearer, so as to prevent undesired rearward dislocation of the protective device during an athletic event.

Figure 16:
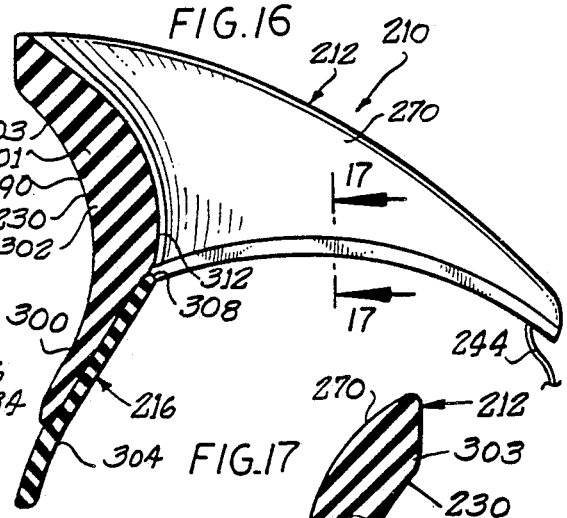

The collar 212 and body member 21 may be integrally formed together by molding or the like process. It is generally preferred, however, that the collar 212 be formed separately from the body 216, and be joined along a continuous seam. With reference to FIG. 16, the preferred two-piece construction of device 210 closely resembles the construction of the preferred embodiment of the device 10, as explained above. For example, the collar 212 has an upright portion 301 and a lower panel portion 300. An outwardly bulging ridge 312 covers or partially overlies a free edge 308 of upper panel 306 of body 216. An offset or ridge 304 at the lower edge of body 216 covers the lower free edge of collar panel 300. Thus, the free edges of the two components of device 210 are effectively prevented from catching on a player's clothing, so as to lift or otherwise cause a separation of the bonded seam between the panels 300, 306.

Figure 17:
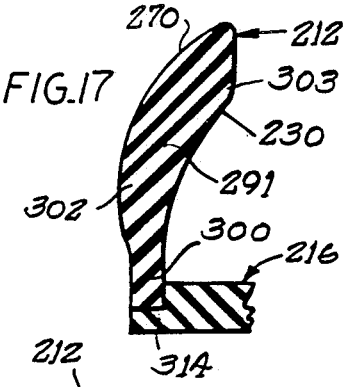
Figure 19:
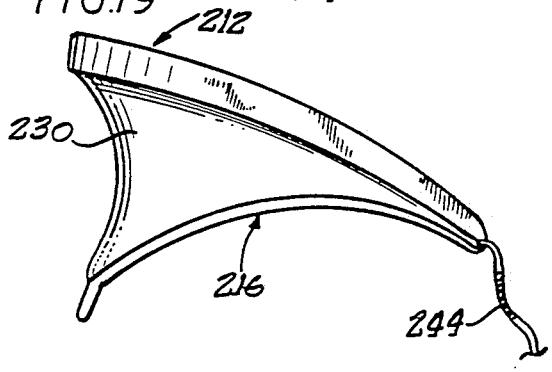
Figure 20:
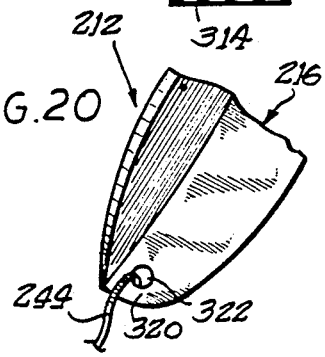

Referring to FIG. 17, collar 212 has an inner convex surface 270 and a generally opposed outer convex surface 230. In general, the collar 212 has the same cross-sectional configuration as that of the collar 12 described above, and attains the advantages of flexing about a line 291, in a manner similar to that described above for the preferred embodiment of FIGS. 1–13. For example, the collar 212 has an upper head-contacting portion 303, and an intermediate portion 302 which provides a resilient hinged connection to a lower boarder panel portion 300. The opposed convex and concave surfaces 270, 230 are portion 302 of the collar, so as to provide the desired flexure and efficient energy dissipation. As will now be described, the flexible collar 12 is joined to the body member in a manner consist with the efficient transmission of forces applied to the upper head-contacting portion of the collar, into the body member 16.

Figure 18:
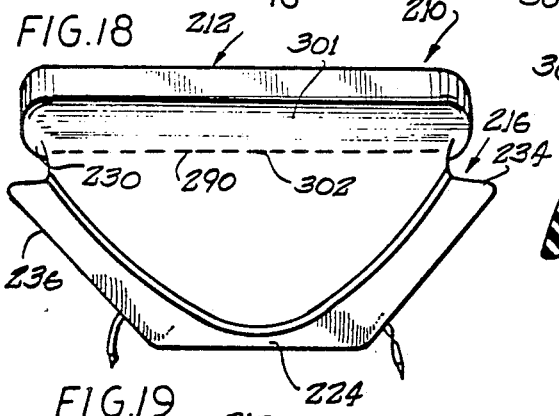

In general, the body 216 is coextensive with collar 212 and is continuously joined thereto. The recess 314, formed at the inner end of body 216 provides a secure bonded joinder between the collar and body members. Referring to FIG. 18, for example, the body member 216 includes a back panel 224, which extends below the lower free end of collar panel 300.

The performance of protective device 210 is substantially identical to that described above with reference to the embodiment of FIGS. 1–13. For example, collar 212 flexes or bends about line 291, so as to increase the concavity of surface 230, collapsing the outer wall 230 of the collar. The outer wall surface 230 of collar 210 readily collapses when a helmet is pressed against the upper portion 301 of the collar, with the collapse increasing the concavity of the outer wall 230. The lower portion 302 of collar 212 acts as a resilient hinge, continuously joining the upper, helmet-contacting portion of the collar to the body 216. Deflection of collar 212 at the resilient hinge portion, absorbs the energy associated with the movement of a player's head and neck, especially when the integrity of the joinder between the collar and the body member 216 is maintained so that the collar and body member cooperate to communicate applied forces therebetween, while preserving the above-described orientation of the collar to the wearer's head and neck.

Figure 14:
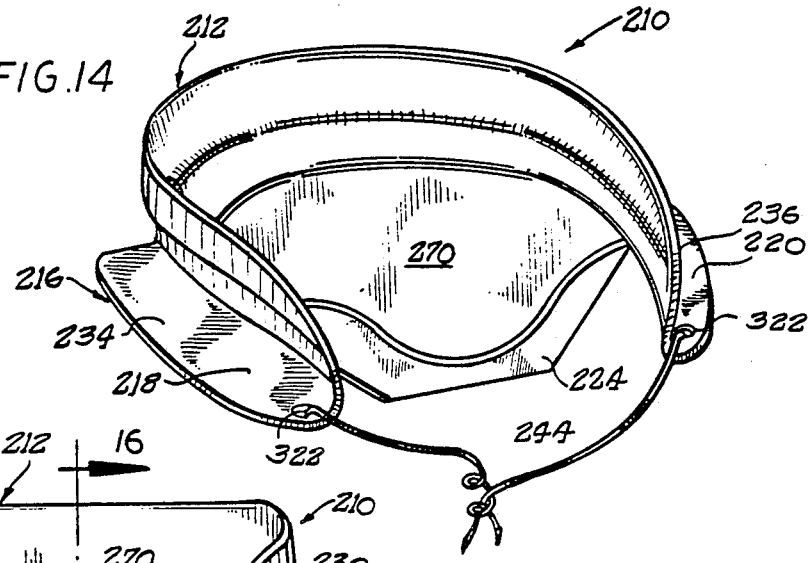
Figure 15:
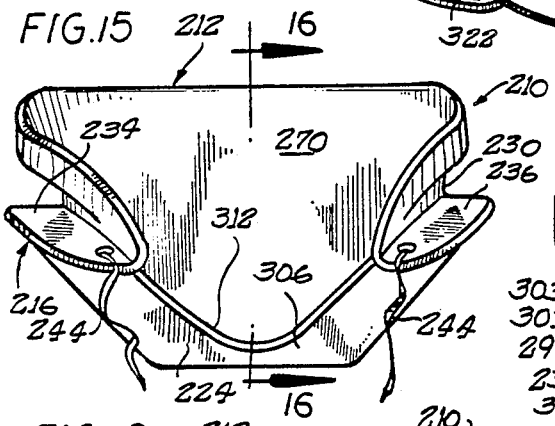

According to one aspect of the present invention, the material of body 216 and the joinder with collar 212 is chosen to dissipate forces to the player's head and neck not only by effectively transmitting a portion of those forces to the player's upper torso, but also by flexing the resilient collar in the aforedescribed desired manner. For example, when helmet 48 is rotated to the side, as in FIG. 12, or to the rear of the player's body, as illustrated in FIG. 14, compressive forces applied to the upper portion of collar 212 are not only resiliently absorbed in the collar, but are also transmitted therethrough into the back and shoulder portions of body 16.

Various features and advantages of the collar according to the present invention have been described above with respect to cross-sectional views of FIGS. 4 and 17, taken at lateral portions of the collars 12, 212, respectively. The collars, according to the present invention, have a continuously blended cross-section, preferably of reduced size at the forward ends of the collar, adjacent the chest panels, and rear portions of the collar are extended for an overlapping joinder with the body portion, as illustrated for example in FIG. 3. The lateral cross-sectional views of FIGS. 4 and 17, however, show an upper head-contacting portion which extends generally throughout the length of the collar and thus the lateral cross-sectional views show typical configurations for dorsal and ventral as well as lateral collar portions.

The cross-sectional configurations of the collars 12, 212 have been noted above as having generally opposed convex and concave inner and outer surfaces, respectively. The cross-sectional configurations have also been described as having a resilient hinge portion joining upper head-contacting portions of the collar to the body of the protective device. The convex and concave surfaces described above extend generally throughout the entire height of the collar, from the body of the device to the uppermost collar surface.

Figure 21:
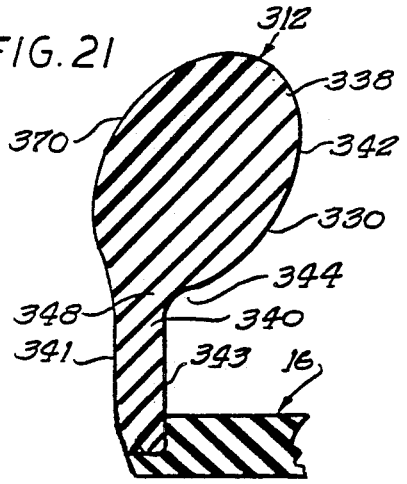
FIGS. 21–25 are fragmentary cross-sectional views showing alternative embodiments of collar portions of the neck guard.

Other arrangements are also possible, and reference will now be made to FIGS. 21–25 which show other embodiments of the present invention. Referring first to FIG. 21, a collar 312 has generally opposed convex and concave, inner and outer surfaces 370, 330, respectively. Collar 3!2 includes a generally cylindrical head-contacting portion 338 joined to the body 16 by an intermediate web portion 340. The cross-sectional view of FIG. 21 shows an alternative joint construction where web portion 340 is fitted in body 16. In the preferred embodiment, the web portion 340 has generally parallel, opposed inner and outer surfaces 341, 343, and is elongated in a vertical direction. The head-contacting portion 338 can have either a right circular or a non-circular cylindrical configuration. The upper head-contacting portion 338 includes an outside, generally outwardly bulging part 342 which cooperates with the web portion 340 to form a concave outer surface portion 344 of the collar.

In the illustrated embodiment, the concave portion 344 is located slightly below, but generally opposite the convex inner surface 370 of the head-contacting portion 338. As those skilled in the art will readily appreciate, by varying the choice of materials used, or perhaps the density of the foam throughout collar 312, bending of the upper head-contacting portion 338 can be localized about a line 348 or can be spread over the vertical height of web 340. The lower portion of web 340 is bonded at 350 to a channel formed in the inner edge of body 16 with a suitable adhesive.

As can be seen in FIG. 21, the upper head-contacting portion and the web portion 340 of the collar also cooperate with the body 16, so as to form a generally three-sided concave cavity which is particularly advantageous for receiving the interior edge of a player's shoulder pads or the like equipment.

Figure 22:
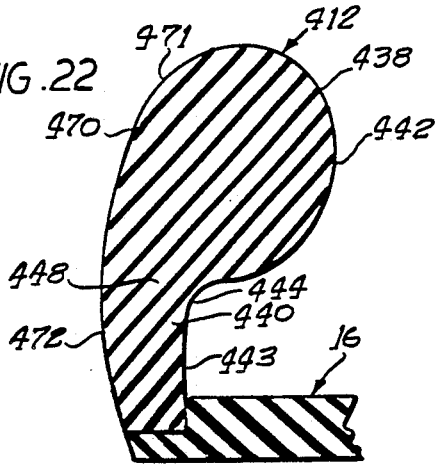

Referring now to FIG. 22, a collar 412 includes an upper head-contacting portion 438 having an outwardly bulging outer part 342. An inner surface 470 comprises a continuous curved surface extending from an upper part 471 for contacting a player's head or helmet, and a lower part 472 comprising the inside surface of a web portion 440. The web portion 440 further includes an external surface 443. As with the collar 312, the outwardly bulging part 442 of collar 412 cooperates with the web portion 440 to form a concave outer surface 444. The web 440 has a slightly different aspect ratio than the web 340 of collar 312, having a reduced height and an enlarged width between its inner and outer surfaces 472, 443. However, by varying the foam density throughout the vertical extent of collar 412, the upper head-contacting portion 438 can be made to bend about a line 448 at the upper end of web 440, or can be distributed throughout the vertical height of the web. As will be seen from the lower portion of FIG. 22, the lower part 472 of the inner collar surface 470 is slightly concave. However, this does not present a problem as there is virtually no risk of a player jamming the bottom edge of his helmet against the inner surface of the collar. An optional interfitting of web 440 and body is also shown in FIG. 22.

Figure 23:
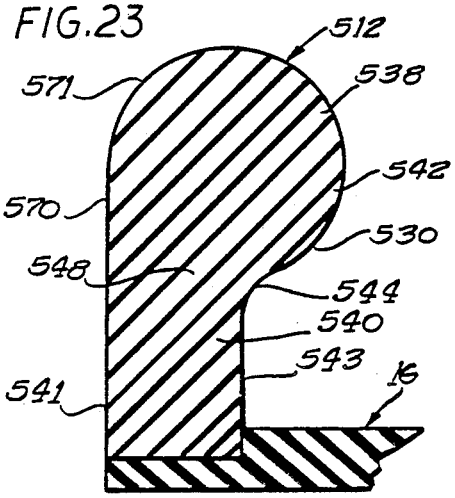

Referring now to FIG. 23, a collar 512 has a generally cylindrical head-contacting portion 538 which is flattened at the interior surface 570 thereof. The upper part 571 of the interior surface of the head-contacting portion, however, is rounded to have a generally convex configuration. As with the preceding alternative embodiments of FIGS. 21 and 22, the head-contacting portion 538 has a generally rounded outwardly bulging external part 542. The upper head-contacting portion 538 is joined to body 16 by a web portion 540. The web portion includes an inner surface 541 preferably comprising a lower extension of surface 570, and a generally opposed exterior surface 543. The upper head-contacting portion can be made to bend about a line 548 at the upper end of web 540, or the bending can be distributed throughout the vertical extent of the web portion. The outwardly protruding part 542 of the head-contacting portion 538 includes an outer surface 530, cooperating with the outer surface 543 of the web to form a generally concave surface portion 544, which contributes to the hingable bending of the upper head-contacting portion, whether that bending is localized at the upper end of the web or is distributed throughout the web. As with the preceding embodiments, the outer surface of the collar cooperates with the body 16 to form a concave cavity.

Figure 24:
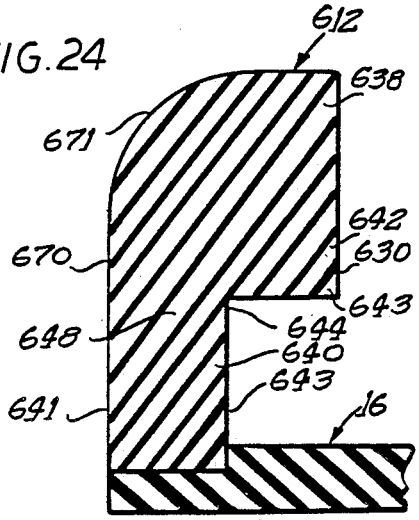

Referring now to FIG. 24, a variation of the collar 512 is generally indicated at 612. Collar 612 includes an upper head-contacting portion 638, with an external outwardly protruding part 642, characterized by a lower outside corner 643 which, unlike the preceding embodiments, does not have a smooth, curved surface. The head-contacting portion 638 has an interior generally flattened surface 670, with a blended upper head-contacting surface 671 of convex configuration. A web 640 joins the upper head-contacting portion to body 16, and includes an inner surface 641, preferably comprising a lower extension of surface 670, and an opposed external surface 643. The external surface 630 of the head-contacting portion 638 cooperates with the external surface 643 of web 640, to form a generally concave surface portion 644 which is slightly lower than, but generally opposes the head-contacting convex surface 671. As with the preceding embodiments, bending of the upper head-contacting surface can be localized at the upper part of web 640, generally along a line 648 or, alternatively, bending can be distributed throughout the web.

Figure 25:
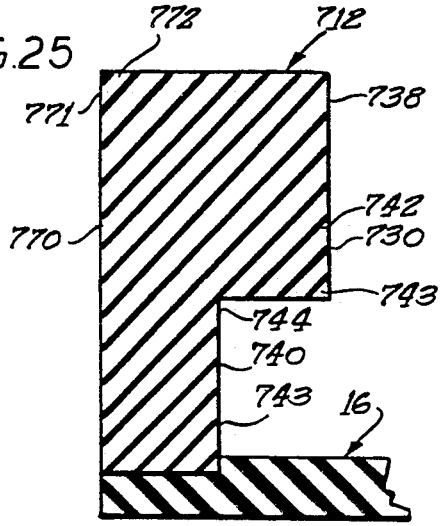

Referring now to FIG. 25, a less preferred alternative of a collar according to the present invention is generally indicated at 712. As with collar 612, the collar of FIG. 25 has an upper head-contacting portion 738, with an outwardly protruding part 742, characterized by an outside corner 743. The outer surface 730 of the head-contacting portion cooperates with an external surface 743 of a web 740, to form a generally concave surface portion 744, to provide advantages as described above. The collar 712 includes an interior surface 770, which extends throughout the entire vertical height of the collar 712. The collar 712 has an upper, interior corner 772 which, unlike the preceding embodiments, does not have the preferred convex configuration. However, the collar 712 could be constructed to have the advantages described above, as long as the vertical height of the collar is sufficiently great so as to extend above the bottom edge of a player's helmet, regardless of the orientation, extension, or angle of flexure of the player's neck. Collar 712 may, accordingly, be slightly more constrictive of a player's movements and might be slightly higher so as to impair a player's lateral vision Accordingly, the collar 712 is generally less preferred than the collars of the preceding embodiments. However, many of the advantages of the preceding embodiments are still obtained.

It can thus be seen that the protective device, according to the present invention includes collar and body members which are either integrally formed one with another, or are joined together at a seam which is preferably comprised of overlapping border portions. When embodied as a multi-component assembly, the protective device preferably includes ridges at the seam joining the collar and body members so as to protect the seam against inadvertent separation.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A protective device for use with helmets of the type worn by players in contact sports, comprising:

a flexible body member of resilient material having shoulder, chest and back portions covering substantial portions of the shoulders, chest and back of a player respectively, said chest portion including two separable parts with releasable joining means to provide ready placement about the upper torso of a wearer;

an upstanding collapsible collar immediately adjacent a central portion of the device, the collar including an upper head-contacting portion with an inner surface defining an upwardly opening passageway for receiving the neck and at least the lower portion of the head of a wearer of the device and a generally opposed concave outer wall surface;

joining means for substantially continuously joining said collar to said chest and said back portions so as to transmit thereto forces applied to the inner surface of the collar upper portion by a head of a wearer or by a helmet worn by the wearer; and said body member having an inner surface for frictionally engaging the body of a wearer so as to maintain said device in a preselected position about the body of a wearer so that displacement of said upstanding collar portion is resisted with a resilient bias force which maintains said collar portion in said preselected position about the body of a wearer.

2. The protective device of claim 1 wherein said inner surface of said collar upper portion is generally convex and said collar further comprises an opposed generally concave outer surface.

3. The protective device of claim 2 wherein said body member and said collar comprise portions of unitary member of resilient material.

4. The protective device of claim 2 wherein said body and said collar are formed separately and are overlapped to form a seam where the two are joined together.

5. The protective device of claim 4 wherein said body member and said collar include depressed panels having an outer free edge and an inner edge forming a ridge with the remainder of the body member, and the remainder of the collar, respectively, the free edge of one panel positioned adjacent a ridge of the other panel so as to prevent the separation of said seam.

6. The protective device of claim 4 wherein said depressed panels of said body member and said collar are bonded together with an adhesive to form said seam.

7. A protective device for use with helmets of the type worn by players in contact sports, comprising:

a one-piece flexible body member of resilient material having shoulder chest and back members at least partially covering the shoulders chest and back of a player respectively, with the chest member including two separable parts to provide ready placement about the torso of a wearer;

a resilient upstanding collar having a lower bending portion and an upper head-contacting portion with an upstanding generally convex inner wall surface defining an upwardly opening passageway for receiving the neck and at least the lower portion of the head of a wearer of the device and the collar further having a concave outer wall surface generally opposite the inner wall surface;

said collar head-contacting portion extending from said bending portion, with said bending portion deflecting to absorb energy when said inner wall surface of said collar is depressed by the head or helmet of a player wearing the device; and said body member having an inner surface for frictionally engaging the body of a wearer so as to maintain said upstanding collar in a preselected position about the body of a wearer despite the application of forces thereto.

8. The protective device of claim 7 wherein said body member and said collar comprise portions of a unitary member of resilient material so as to be substantially continuously joined together.

9. The protective device of claim 7 wherein said body and said collar are formed separately and include depressed panels having an outer free edge and an inner edge forming a ridge with the remainder of said body and said collar, respectively, the depressed panels being overlapped to form a seam where the two are joined together, said head-contacting portion of said collar being substantially continuously joined to said body member by said collar bending portion.

10. The protective device of claim 9 wherein the free edge of one depressed panel is located immediately adjacent the ridge of the other panel so as to prevent the separation of said seam.

11. The protective device of claim 10 wherein the depressed panels of said body member and said collar are bonded together with an adhesive to form said seam.

12. A protective device for use with helmets of the type worn by players in contact sports, comprising:

a flexible body member of resilient material having shoulder and back parts at least partially covering the shoulders and back of a player respectively;

a resilient upstanding collar having a lower bending portion, an upper head-contacting portion with an upstanding inner wall surface defining an upwardly opening passageway for receiving the neck and at least the lower portion of the head of a wearer of the device and a generally opposed concave outer wall surface;

said collar further including a generally triangular back portion with a downwardly extending tip, disposed below said bending portion;

said bending portion joining said collar head-contacting member to said body member, with said bending portion deflecting to absorb energy when said inner wall surface of the head-contacting portion is depressed by the head or helmet of a player wearing the device; and said body member having an inner surface for frictionally engaging the body of a wearer so as to maintain said upstanding collar in a preselected position about the body of a wearer despite the application of forces thereto.

13. A protective device for use with helmets of the type worn by players in contact sports, comprising:

a flexible body of resilient material having shoulder and back parts at least partially covering the shoulders and back of a player, respectively;

a resilient upstanding collar having a lower bending portion an upper head-contacting portion with an upstanding inner wall surface defining an upwardly opening passageway for receiving the neck and at least the lower portion of the head of a wearer of the device and a generally opposed concave outer wall surface;

said collar head-contacting portion extending from said bending portion which deflects to absorb energy when said inner wall surface of said collar is depressed by the head or helmet of a player wearing the device;

said body member comprising at least one pliable chest part conforming to the chest of the wearer, comprised of two separable portions with releasable fasteners for releasably joining the separable parts together to provide ready placement about the upper torso of a wearer, said body member further having an inner surface for frictionally engaging the body of a wearer so as to maintain said upstanding collar in a preselected position about the body of a wearer despite the application of forces thereto; and said body, said bending portion and said collar being of one-piece construction of resilient material so that displacement of said upstanding collar with respect to said chest and back parts is resisted with a resilient bias force so as to further maintain said collar in said preselected position about the body of a wearer.

14. A protective device for use with helmets of the type worn by players in contact sports, comprising:

a flexible body member of resilient material having shoulder and back parts at least partially covering the shoulders and back of a player respectively, said body member further including at least one pliable chest part conforming to the chest of the wearer, comprised of two separable portions to provide ready placement about the upper torso of a wearer;

a resilient upstanding collar having a lower bending portion an upper head-contacting portion with an upstanding inner wall surface defining an upwardly opening passageway for receiving the neck and at least the lower portion of the head of a wearer of the device and a generally opposed concave outer wall surface;

said collar head-contacting portion extending from said bending portion which deflects to absorb energy when said inner wall surface of said collar is depressed by the head or helmet of a player wearing the device;

said body member having an inner surface for frictionally engaging the body of a wearer so as to maintain said upstanding collar in a preselected position about the body of a wearer despite the application of forces thereto; and said body, bending portion and collar being of one-piece construction of resilient material such that displacement of said upstanding collar with respect to said chest and back parts is resisted with a resilient bias force so as to further maintain said collar in said preselected position about the body of a wearer.

15. A protective device for use with helmets of the type worn by players in contact sports, comprising:

a flexible body member of resilient material having shoulder and back portions at least partially covering the shoulders and back of a player respectively;

an upstanding collar of resilient material having a generally convex inner wall surface defining an upwardly opening passageway for receiving the neck and at least the lower portion of the head of a wearer of the device and said collar further having a generally opposed concave outer wall surface having a first concave configuration when unstressed, with an upper head-contacting portion disposed between said convex inner surface and said outer concave surface;

joining means for joining said upstanding collar to said body member so as to transmit forces to the body member which are applied to said upstanding collar by the head or helmet of a player wearing the device;

said upstanding collar being resiliently deformable so as to at least partially collapse said outer wall surface, increasing the concavity thereof when pressure is exerted against the inner surface of the collar by the head or helmet of a player wearing the device; and said body member having an inner surface for frictionally engaging the body of a wearer so as to maintain said upstanding collar in a preselected position about the body of a wearer despite deformation of said upstanding collar portion.

* * * * *